US006315239B1

(12) United States Patent
Voigt

(10) Patent No.: US 6,315,239 B1
(45) Date of Patent: Nov. 13, 2001

(54) VARIABLE COUPLING ARRANGEMENT FOR AN INTEGRATED MISSILE STEERING SYSTEM

(75) Inventor: Allan A. Voigt, Geyserville, CA (US)

(73) Assignee: Versatron, Inc., Healdsburg, CA (US)

( * ) Notice: Subject to any disclaimer, the term of this patent is extended or adjusted under 35 U.S.C. 154(b) by 324 days.

(21) Appl. No.: 08/935,571

(22) Filed: Sep. 23, 1997

(51) Int. Cl.[7] ..... F41G 7/00

(52) U.S. Cl. ..... 244/3.22; 60/228; 239/265.29; 239/265.31; 244/169

(58) Field of Search ..... 244/3.22, 3.21, 244/3.24, 169, 52, 73 R, 76 J; 239/265.19, 265.29, 265.31; 60/232, 230, 228

(56) References Cited

U.S. PATENT DOCUMENTS 4,826,104 * 5/1989 Bennett et al. ..... 244/3.22
4,955,558 * 9/1990 Machell et al. ..... 244/3.22
5,016,835 5/1991 Kranz .
5,405,103 * 4/1995 Girardeau et al. ..... 244/3.22
5,456,425 * 10/1995 Morris et al. ..... 244/3.22
5,505,408 4/1996 Speicher et al. .
5,630,564 * 5/1997 Speicher et al. ..... 244/3.24

* cited by examiner

*Primary Examiner*—Harold J. Tudor
(74) *Attorney, Agent, or Firm*—Henry M. Bissell

(57) ABSTRACT

An integrated system for missile steering, which uses both jet reaction control (JRC) and aerofin control systems, is provided with a variable coupling mechanism for adjusting the relative responsiveness of the two systems in accordance with the pressurization state of the JRC system pressure chamber. In one embodiment, the pivoting action of a joystick which actuates the gas flow control pintles of the JRC system is permitted only under sufficient pressurization of the pressure chamber. In a second embodiment, the extent to which the pintles protrude from their controllable housings is adjusted according to the pressure in the pressure chamber. In this manner, when JRC is undesirable or is unavailable, the missile aerofins are permitted their full range of motion without being constrained by the pintles.

21 Claims, 15 Drawing Sheets

VARIABLE COUPLING ARRANGEMENT FOR AN INTEGRATED MISSILE STEERING SYSTEM

BACKGROUND OF THE INVENTION

1. Field of the Invention

This invention relates to rocket propelled vehicles such as missiles, and more particularly, to arrangements for steering such vehicles by a combination of steering fin control and jet reaction control.

2. Description of the Related Art

Missile control can be effected using a variety of steering schemes. One such scheme involves pivoting the thrust vectoring nozzle of the missile about a pivot point and controlling the direction of its thrust in order to provide steering in a desired direction.

Another method utilizes movable aerofins projecting into the airstream around the missile. This imparts to the missile the necessary forces to change its direction during flight within the earth's atmosphere and thereby effect steering control.

Jet reaction control (JRC) provides yet another method for steering a missile during flight, and is shown in U.S. Pat. No. 5,016,835 of Kranz. This method involves selective firing of jet nozzles disposed radially around the periphery of the missile in order to orient the missile in a desired direction. The fired jets impart an opposing reactive force on the missile and, depending on their arrangement, can serve to produce a change in direction along the yaw, pitch and/or roll axes.

It is also known in the art to effect missile control during flight using a combination of steering methods. One such combination, disclosed in U.S. Pat. No. 5,505,408 of Speicher et al., assigned to the same assignee as the present invention and incorporated herein by reference, relies on both jet reaction control (JRC) and control actuator fins. The two steering schemes operate in conjunction with one another to effect missile control, and yield a particularly advantageous arrangement because in some situations, when the dynamic pressure is low, such as during high attack angles or in a reduced atmosphere, the jet reaction control mechanism can compensate for the diminished effectiveness of the steerable aerofins, avoiding a compromise of missile maneuverability.

SUMMARY OF THE INVENTION

Arrangements in accordance with the present invention use an integrated missile steering system in which both jet reaction control and steerable aerofins are employed. An improved mechanical linkage between the jet reaction control and the steerable aerofins is provided, enhancing overall system performance. Use is made of a variable coupling arrangement which operates to completely decouple the two steering mechanisms or to change their relative responsiveness to steering command signals.

Different embodiments of the invention utilize various mechanical linkages between the steerable aerofins and the pintles which control the efflux of exhaust gases from the nozzles of the jet reaction control mechanism. These mechanical linkages can be arranged such that the ratio between the fin motion and the pintle motion can be adjusted so that small fin motions give large pintle motions. Moreover, the invention allows large pintle motions with small fin motions to be used initially in the missile flight and then, upon-burn out of the thrust vectoring gas generator, allows large fin motions without over stroking the pintle actuator. Use with a multiple burn gas generator is also contemplated, where the pintles would decouple between gas generator burns and couple during burns.

According to the invention, the decoupling is performed in a cost effective and highly reliable manner, allowing full motion of the aerofins without damage to the pintles or pintle drive mechanisms. Two implementations are employed, one in which a yoke plate is used, and the other in which differential area pistons in the pintles themselves are used.

According to the first, yoke plate arrangement, use is made of a simple mechanism which effectively unlocks the pivot bearing of the joystick lever which manipulates the individual pintles, allowing the joystick to move sideways, rather than to pivot about a point, when forces are applied thereto by the yoke plates, effectively disengaging it from the pintles. This mechanism is reliable and Low cost and is simply activated by the process of pressurizing the gas generator. Upon pressurization of the gas generator, a piston is pushed axially to capture the pivot bearing of the joystick, preventing ineffectual sideways movement of the pivot bearing and joystick and coupling the joystick to the pintles. When pressure is released at burn-out of the gas generator, forces on the joystick push the piston axially to unlatch the pivot bearing. The result is a system which is normally unlocked until the gas generator is pressurized and which stays locked during gas generator pressurization and then subsequently unlocks at depressurization. This allows full aerofin control during periods of the flight when jet reaction control is not desired or is unavailable. It also allows different ratios to be selected to optimize the response of the pintle actuators while the aerofin in motion could be restrained due to this ratio selection. An alternative embodiment uses radially, rather than axially, mounted pistons.

The second arrangement provides the mechanical coupling using a differential area piston in the pintle itself. This differential area piston extends the pintle to an internal hard stop when the gas generator chamber is pressurized. This allows normal functioning of the gas generator and pintle system at pressurization. Upon depressurization or burn out, the differential area piston allows the pintle to move axially when the aerofin actuator causes the pintle to contact the nozzle throat. This system is inherently simple and relies on chamber pressure to control the pintle state and allows inherent decoupling from the aerofin actuator upon depressurization. If the pintle repressurizes, the pintles are recoupled to the stick.

In one configuration the joystick is dispensed with and the pintle is driven by a pinion coupled directly to the actuator which operates the aerofins. A dual pintle arrangement is used, with dual differential area pistons which cause the pintles to be extended internally until they reach a hard stop. When the chamber pressure drops, the pintles are allowed to retract into the housing which supports them, thereby allowing the aerofin actuator to have larger strokes than a hard mounted pintle would.

DESCRIPTION OF THE DRAWINGS

A better understanding of the present invention may be realized from a consideration of the following detailed description, taken in conjunction with the accompanying drawings, in which.

DETAILED DESCRIPTION OF THE PREFERRED EMBODIMENTS

Figure 1:
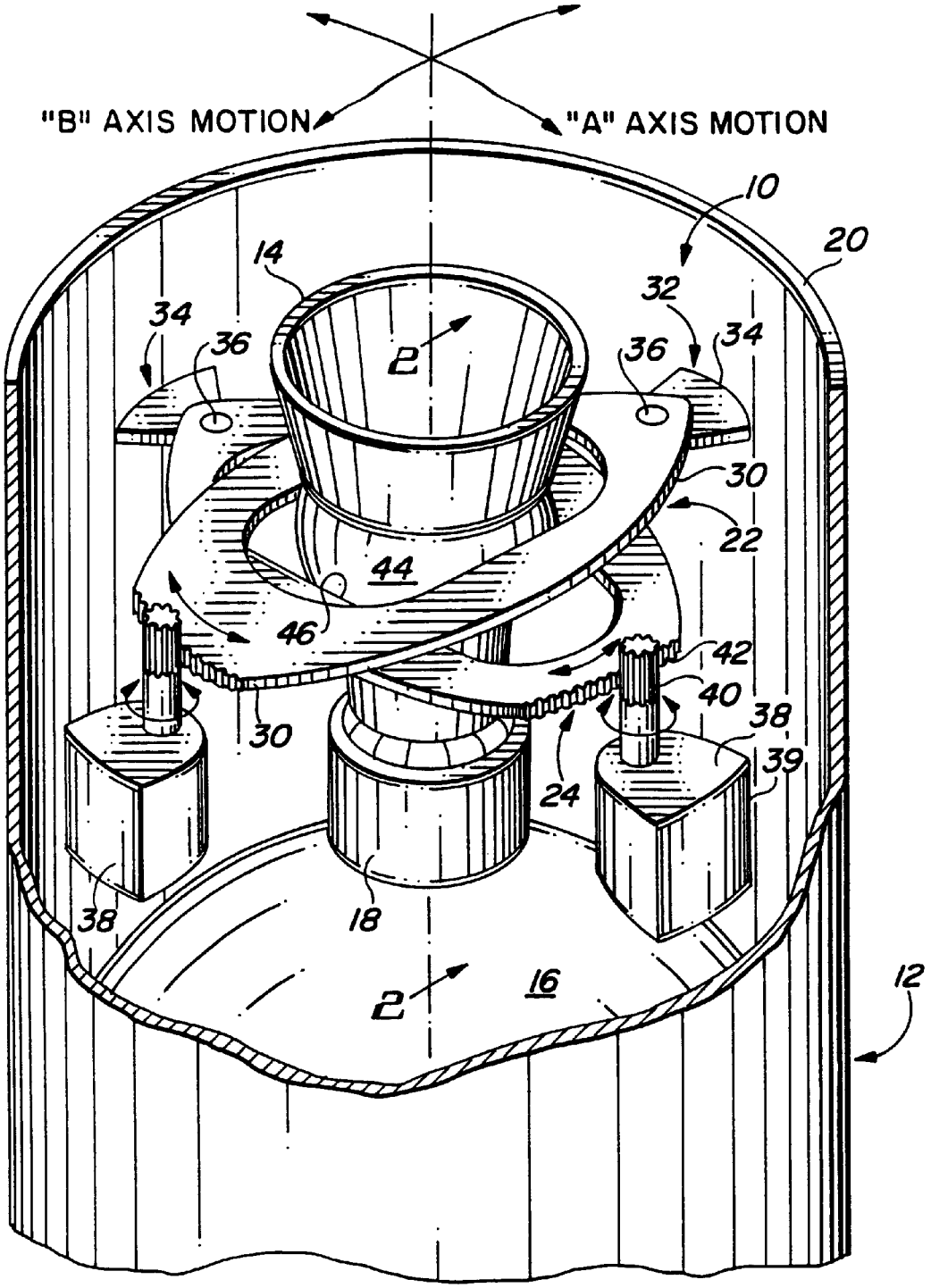
FIG. 1 (PRIOR ART)
FIG. 1 is a schematic perspective view, partially broken away, illustrating one particular prior art arrangement.
Figure 2:
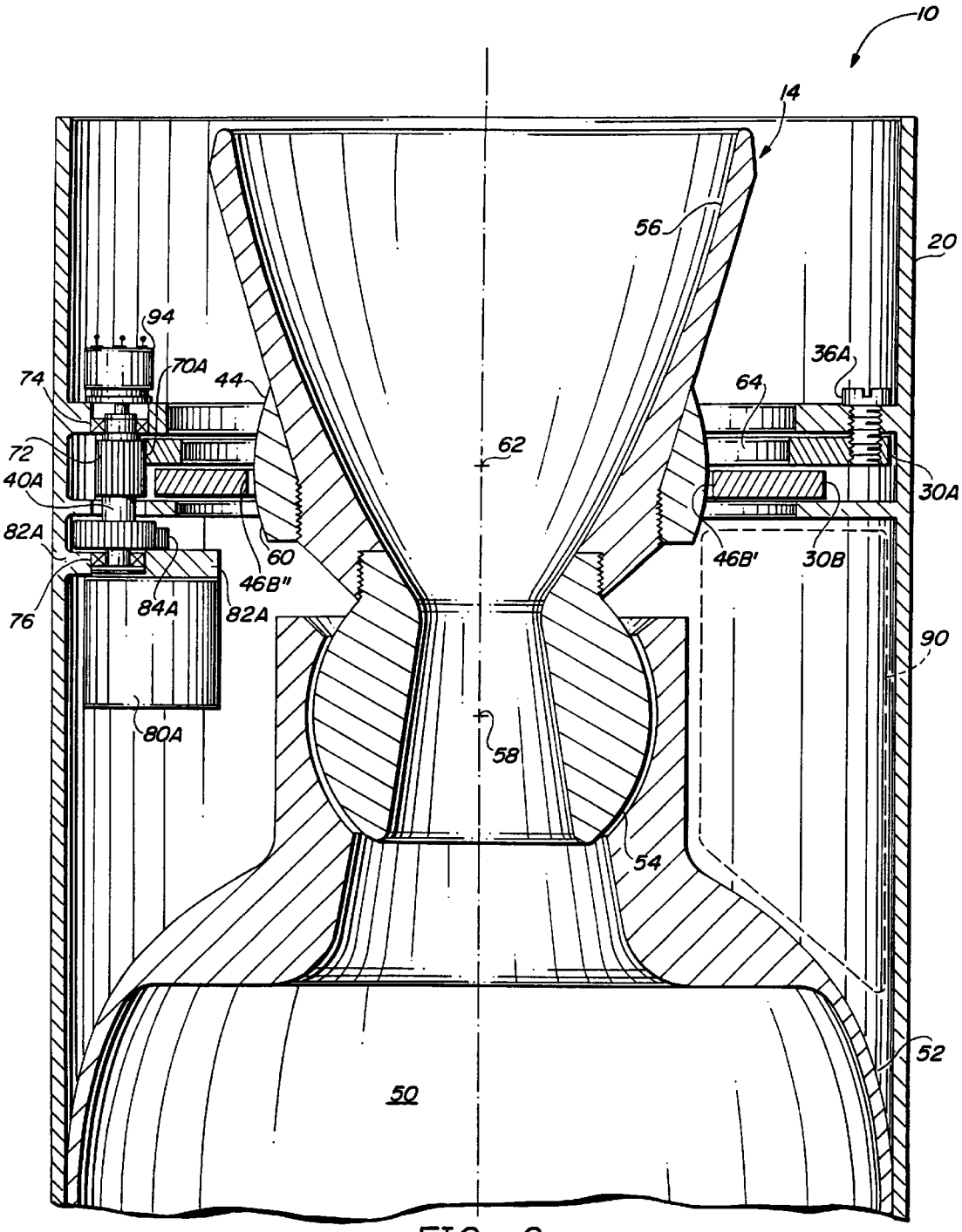
FIG. 2 (PRIOR ART)
FIG. 2 is a side-sectional view of the arrangement of FIG. 1, taken along line 2—2 thereof and showing certain structural details.

FIGS. 1 and 2 show a prior art missile steering system in which a steerable nozzle is used to effect control of the missile. This system is known as a thrust vectoring control system (TVC). A nozzle actuation system 10 is shown in conjunction with a missile 12 having a steerable nozzle 14 mounted to a rocket motor 16 via a ball and socket joint 18, and an encompassing skin 20 which is partially broken away to show details of the steering arrangement therein. The nozzle actuation system 10 comprises a pair of nozzle actuators 22, 24 which are oriented orthogonally from each other in adjacent planes which are generally transverse to the missile central axis to effect steering of the nozzle 14 relative to two orthogonal "A" and "B" axes, respectively. Thus, the actuator system 10 is able to drive the nozzle 14 about the two orthogonal axes A and B for omni-directional steering.

Each of the individual actuators 22, 24 includes a yoke plate 30 and anchoring means at opposite ends of the yoke plate for anchoring the actuator to the missile skin 20. At one end of each yoke plate 30, the anchoring assembly 32 comprises an anchor 34 which is affixed to the inner surface of the skin 20 and serves as a pivot mount for the yoke plate 30 via a pivot pin 36.

At the opposite end of each yoke plate 30, the anchoring arrangement comprises a gear motor 38 contained in a housing 39 which is affixed to the inner surface of the skin 20. Projecting from the housing 39 is a shaft gear 40 which is adapted to engage the adjacent end of the yoke 30 which is fashioned with gear teeth comprising part of a sector gear 42.

Completing the actuation system 10 of FIG. 1 is a yoke seat 44 which is mounted circumferentially about the nozzle 14 within the openings of the elongated yoke plates 30. The yoke seat 44 is formed as a segment of a sphere to provide sliding contact points, such as at 46, to support the bearing loads generated by the yoke plates 30. The seat 44 is spherically cut and has a center on the nozzle center line at a point approximately in line with the central plane between the two yoke plates 30.

Each yoke plate has an elongated central opening defined by two arms which extend about the nozzle. These arms have bearing surfaces adjacent the nozzle yoke seat for transmitting lateral forces to the nozzle 14 while permitting sliding contact with the yoke seat 44.

FIG. 2 illustrates particular structural details of the nozzle system 10 of FIG. 1. A generic rocket motor is pictured having a pressure vessel volume 50 and an aft closure 52 which contains the socket for a spherical ball and socket pivot 54. The nozzle exit cone 56 of nozzle 14 is attached to the ball portion of the pivot 54 such that the exit cone 56 is constrained to rotate with three degrees of freedom about a point 58 in the center of the ball and socket pivot 54.

The spherically cut surface 60 of yoke seat 44 is threadably mounted to the outside of the nozzle 14. The surface 60 affords a suitably strong seat for contact with the two yoke plates 30A, 30B at four point. Two of these points are indicated at 46B' and 46B" in FIG. 2 for the yoke plate 30B. The yoke seat 44 is spherically cut about a point 62 located along the center line of the exit cone 56 and nominally on a plane midway between the two yoke plates 30A, 30B. Forces transmitted through the points of contact between the yoke plates 30A and 30B and the yoke seat 44 generate torque which drives rotation of the nozzle 14 about the A and B axes.

The A-axis actuator 22 comprises yoke plate 30A which is attached to the missile skin structure 20 through a pivot pin 36A. The yoke plates 30A, 30B are constrained to move in planes about their respective pivot pins 36 by the surrounding structure—i.e., the skin structure 20 fore and aft—as they are driven by the gear motor arrangement 38. Each yoke plate 30A, 30B contains an elongated slot 64A or 64B. The yoke seat 44 lies within the slots 64A, 64B and makes contact at two points on opposite sides of each of the yoke plates 30A, 30B. The slots 64A, 64B and seat 44 are cut for a slight clearance, so that the yoke plates 30A, 30B are not actually in contact with the seat at both contact points at the same time, but rather will contact one point or the other depending upon the direction of applied forces. Each yoke plate 30A, 30B has gear teeth 70A or 70B cut into the plate at one end to establish a sector gear portion which is driven by a cluster shaft pinion 72 (FIG. 1). The cluster shaft is mounted by bearings 74, 76 to the missile skin structure 20. The A-axis drive motor 80A is mounted on tabs 82A of the missile skin structure 20. The motor shaft pinion 84A drives the cluster shaft 40A. Clearance slots are cut into the yoke plates 30A, 30B to allow long rotation of the yoke plates without interference from the other axes cluster pinions 72.

The B-axis drive is essentially identical to the A-axis drive. The B-axis yoke plate 30B is positioned next to, but in front of, the A-axis yoke plate 30A. Its pivot pin 36B is similarly attached to the missile structure 20, and yoke plate 30B has sector gear teeth 70B driven by an engaged pinion 72B on shaft 73B.

Figure 3:
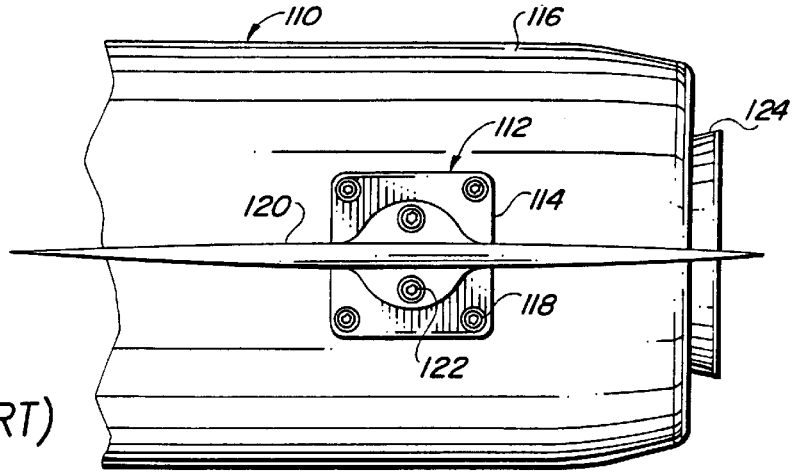
FIG. 3 (PRIOR ART)
FIG. 3 is a schematic view showing the mounting of a single aerofin on a missile housing.
Figure 4:
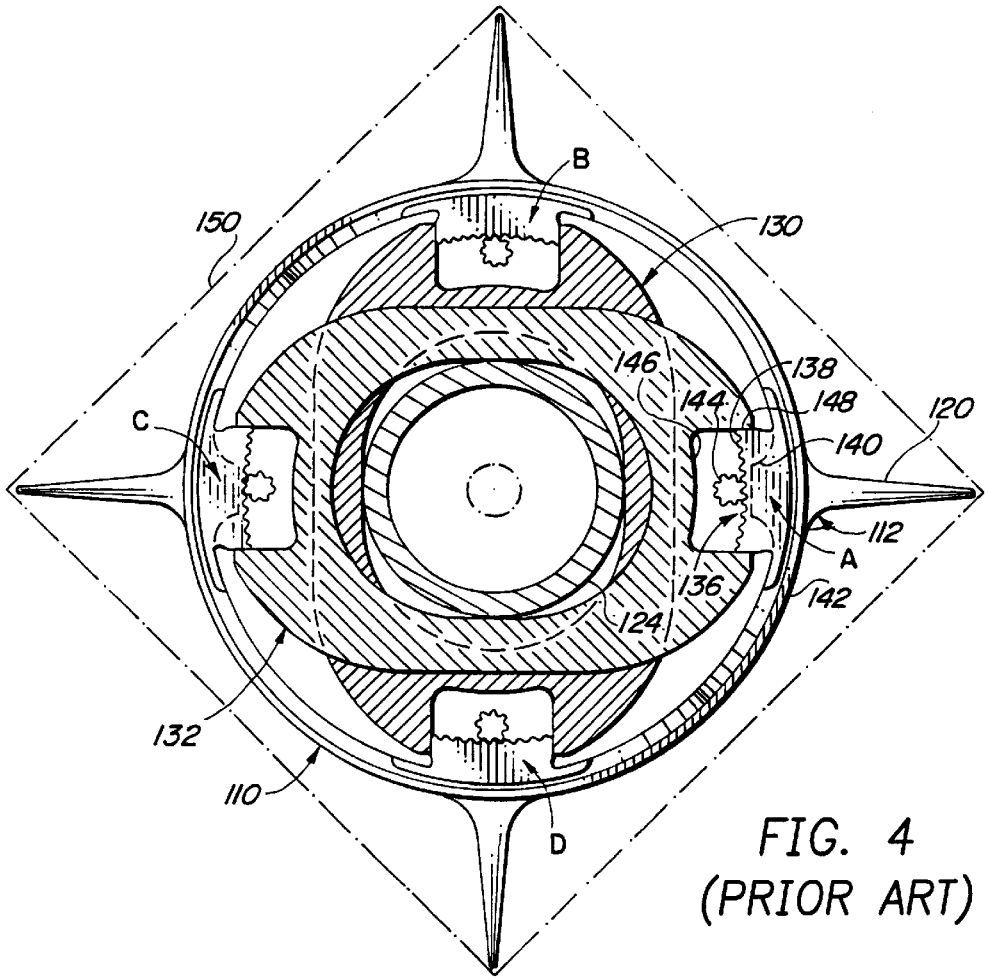
FIG. 4 (PRIOR ART)
FIG. 4 is a schematic cross-sectional view showing the general orientation of aerofins and yoke plates in a typical prior art arrangement.

Rather than pivoting each of the yoke plates at one of its anchoring points, a mounting arrangement in which the yoke plates are permitted to translate along orthogonal axes can be provided (FIG. 4). Additionally, in combination with the thrust vectoring control (TVC) system using a pivotable nozzle, steerable aerofins can be employed to augment missile steering control in an integrated steering arrangement, illustrated in prior art FIGS. 3–5. FIG. 3 is a schematic diagram representing a missile 110 with an aerofin assembly 112 installed thereon. The assembly 112 comprises an aerofin 120 pivotably installed on a base plate 114 which is secured to the skin 116 of the missile 110 by means of mounting bolts 118. The aerofin 120 is affixed to an internal drive mechanism by mounting bolts 122. The exhaust nozzle of the missile 110 is represented schematically at 124. The pivotable mounting of the nozzle 124 corresponds to that which is shown in FIGS. 1 and 2.

FIG. 4 is a schematic diagram illustrating the drive elements of the steering control system of the prior art. A pair of orthogonally oriented yoke plates 130, 132 are shown bearing against the steerable nozzle 124 to control thrust direction in a manner similar to that of the prior art arrangement depicted in FIGS. 1 and 2. A principal difference from that device is that each of the yoke plates 130, 132 is free to move in response to rotational forces applied at both opposite ends thereof, rather than being pivotally anchored at one end as indicated in FIG. 1.

The details of the yoke plate drive assemblies are shown for the unit A at the position of the aerofin assembly 112. A rack and pinion gear assembly 136 comprises a curved rack gear 138 on a rack carrier 140. The carrier 140 is curved on its outer surface to match the curvature of the missile shell 142 and is adapted to slide circumferentially relative to the missile shell 142 as it is driven by the spur or pinion gear 144. The corresponding end of the yoke plate 132 is provided with a U-shaped recess 146 in which the rack carrier 140 is mounted, bearing against side walls 148 of the recess 146. This arrangement is repeated at the other three aerofin stations B, C and D located at 90 degree spacings about the missile.

In FIG. 4, the broken line outline 150 indicates the typical launcher envelope for such a system. It will be apparent that, as the pinion gear 144 is driven to rotate, it moves the rack carrier 140 either clockwise or counterclockwise, depending upon the direction of rotation of the pinion gear 144. Corresponding movement of the yoke plate 132 moves the nozzle 124 off axis, thereby changing the direction of the thrust to effect steering of the missile.

Figure 5:
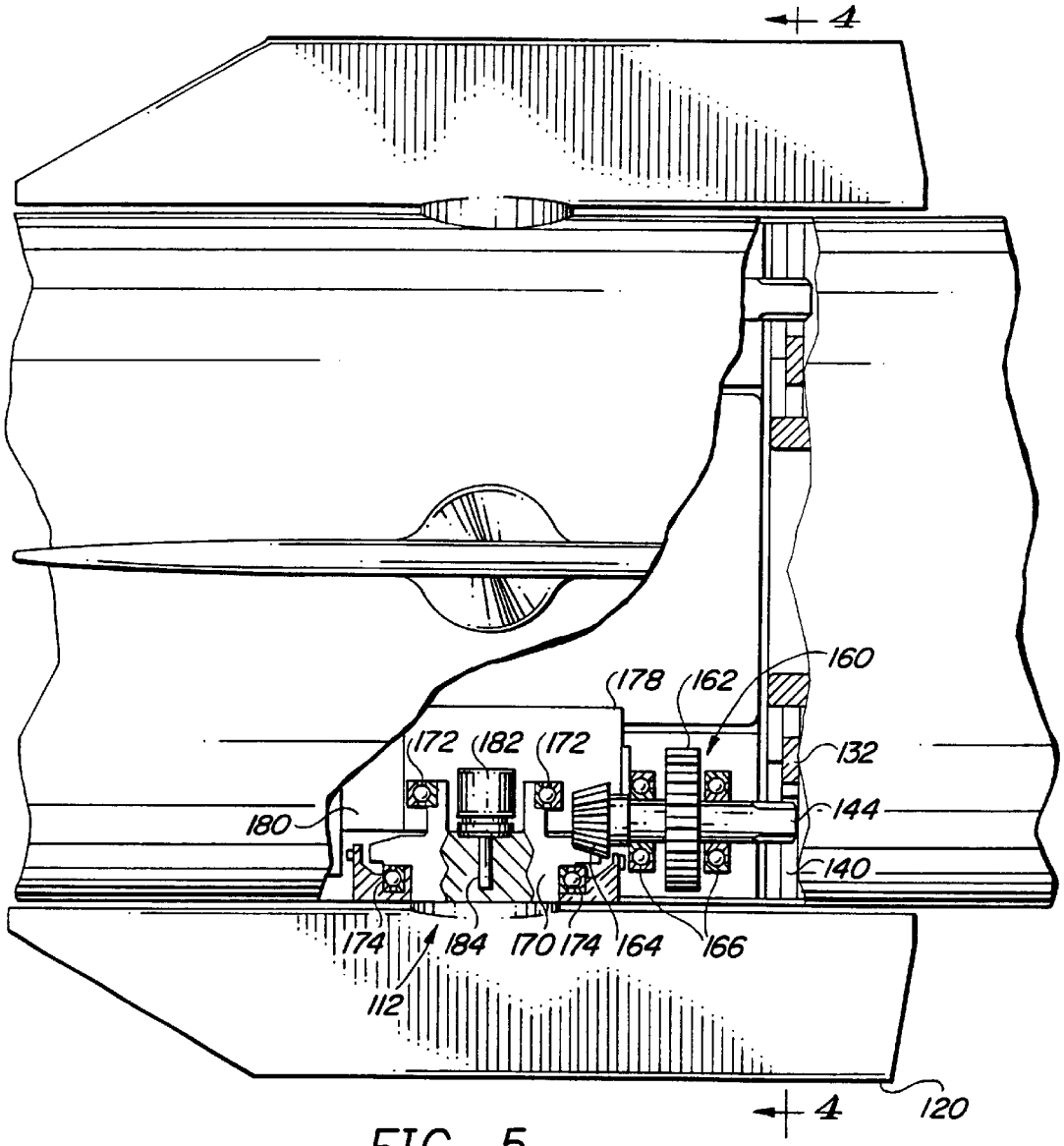
FIG. 5 (PRIOR ART)
FIG. 5 is a schematic side view, partially broken away, showing some of the details of the internal drive mechanism employed in arrangements such as FIG. 4.

FIG. 5 illustrates schematically the details of the combination drive arrangement for an aerofin in 112 and a yoke plate 132. This view shows the combined aerofin and TVC dual pinion gear 160 having a central drive gear 162 mounted on a common shaft with pinion gear 144 and a bevel pinion gear 164. The shaft of the dual pinion gear 160 is mounted in bearings 166.

A bevel gear 170 is directly connected to the aerofin 120 and is coupled to the bevel pinion gear 164. Gear 170 is mounted for rotation in upper and lower bearing 172, 174. An electric motor 180 has an output shaft coupled to drive the gear 162 which in turn produces rotation of both the bevel gear 170 and the pinion gear 144, thus driving both the aerofin 120 and the rack 140. This in turn drives the yoke plate 132. A feedback transducer 182 is connected to the aerofin bevel gear 170 by a shaft 184, thereby providing aerofin position data for the control system of the drive arrangement 100. The coupling between the motor 180 and the gear 162 is represented by the block 178. This preferably incorporates a speed reducing gear train to transform the motor's relatively high speed and low torque into low speed and high torque. Such speed reducers are known in the art; details are omitted from FIG. 5 for simplicity.

Figure 6:
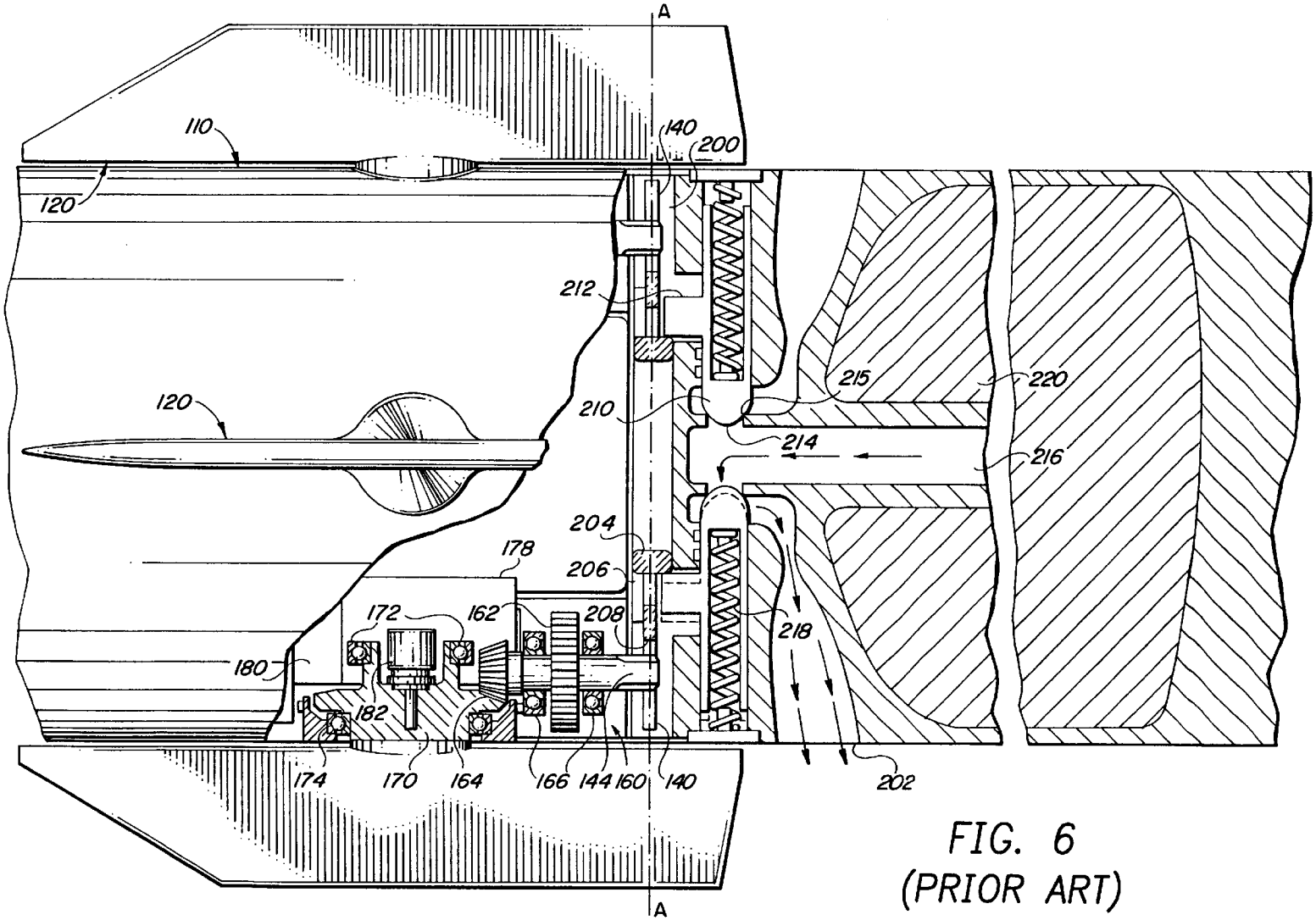
FIG. 6 (PRIOR ART)
FIG. 6 is a schematic side view, partially broken away, showing some of the details of the internal drive mechanism employed in a typical integrated system using jet reaction control and control actuator fins.
Figure 7:
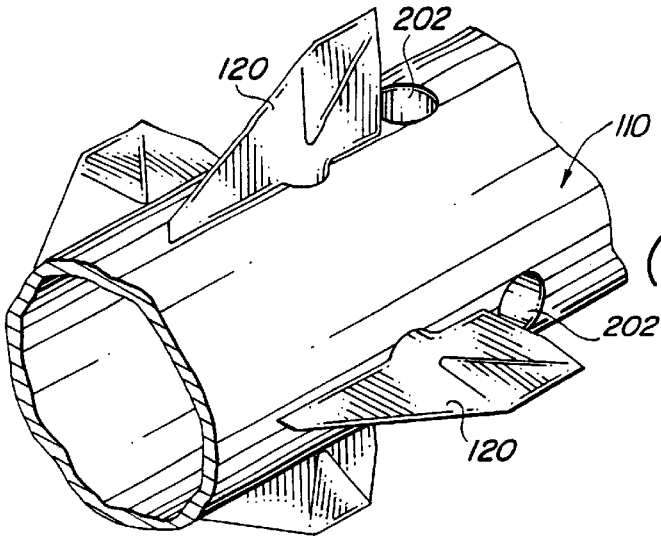
FIG. 7 (PRIOR ART)
FIG. 7 is a partial view of the exterior of a missile incorporating the embodiment of FIG. 6 and depicting essentially the same portion depicted in FIG. 6.
Figure 8:
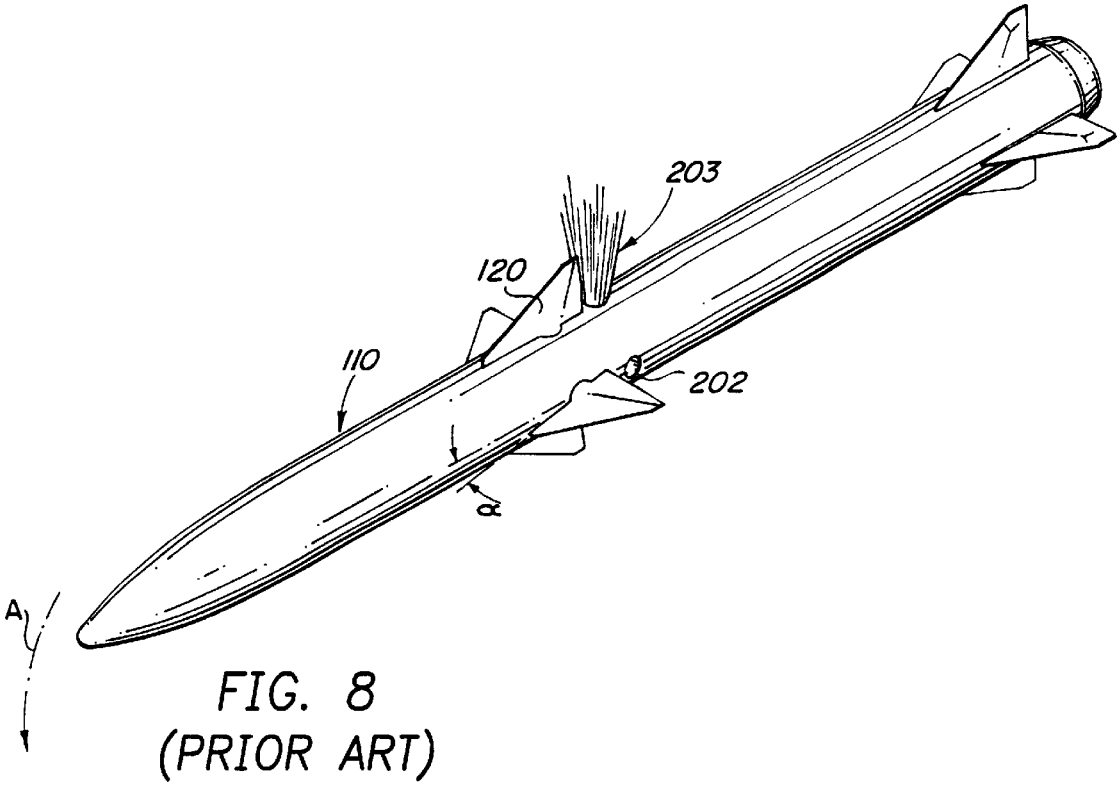
FIG. 8 (PRIOR ART)
FIG. 8 is an operational view of a missile incorporating the embodiments of FIGS. 6 and 7.
Figure 9:
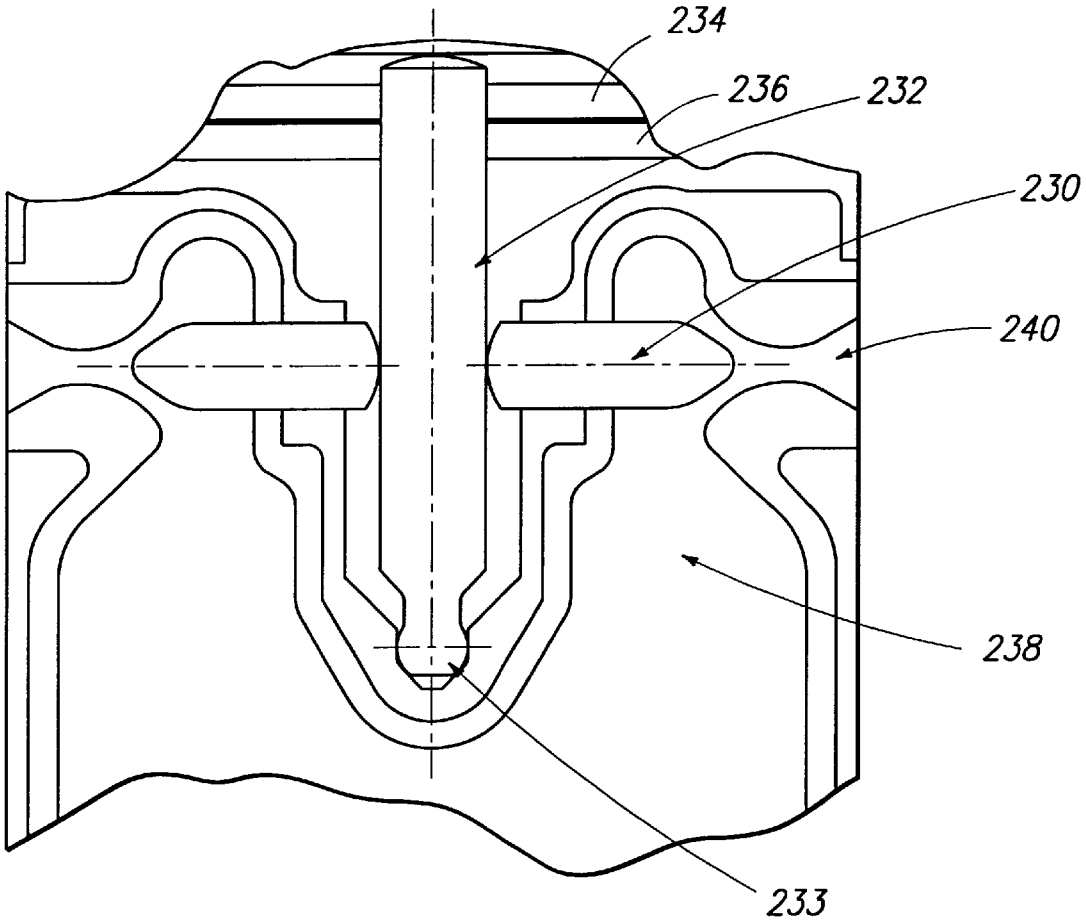
FIG. 9 is a schematic view of a joystick actuated pintle system.

A different integrated steering arrangement, which uses, a combination of aerofin in and jet reaction control (JRC), is represented schematically in FIGS. 6–8. FIG. 6 shows an actuator assembly like that depicted in FIG. 5, except that here the actuator assembly serves to control an associated auxiliary jet steering system rather than the thrust vector control system of the main nozzle as previously described.

The actuator assembly portion of FIG. 6 to the left of the broken line A—A is the same as that shown in FIG. 5 and the same reference numerals are used to identify like elements. It should be clear, of course, that there are four of the assemblies like the one depicted at the bottom of FIG. 6, one for each of four fins 120 mounted at 90 degree angles about the missile 110.

The jet reaction control portion of the arrangement of FIG. 6 is shown comprising a JRC housing 200 mounted just aft of the yoke plates 206, 208 which are positioned to control the movement of the valve control puck 204. These elements correspond to or are equivalent in operation to the yoke plates 130, 132 and the steerable nozzle 124 in the FIG. 4 representation of the first preferred embodiment, described hereinabove.

The housing 200 encompasses four rocket nozzles 202 and four associated rocket valves 210 situated about a central pressure inlet 216 from a rocket motor or other pressure source 220. These rocket nozzles and valves may be oriented to exhaust directly behind the aerofins 120, as indicated in FIG. 6 or they may be angularly displaced therefrom as desired, for example, displaced by 45 degrees so that the nozzles exhaust midway between the aerofins 20.

Each valve 210 is generally cylindrical with a bullet nose 214 bearing against a valve seat 215. The valve 210 is hollow and contains a spring 218 therein for urging nose 214 of the valve 210 against the seat 215 to close off the associated passage from the pressure inlet 216 to a corresponding nozzle 202. To one side of the valve 210 is a valve arm 212 which bears against the outer surface of the valve control puck 204. Thus as the puck 204 is moved off the central axis of the missile by the actuator assembly, as previously described, it drives one or another of the valve arms 212 and associated valve 210 radially outward, thereby drawing the nose 214 away from the seat 215 to a valve-open position, as indicated in the broken line of the lower valve in FIG. 6, so that gas from the pressure inlet 216 connects through that valve passage to the bottom nozzle 202 in FIG. 6.

The effect of opening one of the valves 210 in this manner is illustrated in FIGS. 7 and 8. FIG. 8 shows a portion of a missile body with aerofins 120 and a nozzle 202 mounted directly behind the aerofins. The operation of this system is represented at FIG. 8 where the portion of FIG. 7 is shown installed on the missile as a canard system. The aerofins 120 are shown rotated to cause a force pushing the nose of the missile 110 down. Similarly, the exhaust 203 from the nozzle 202 in the uppermost position operates to produce the same effect, driving the nose of the missile downward to produce a directional change indicated by the arrow A.

In accordance with a first embodiment of the invention, illustrated in FIGS. 9—13, the valves 210, hereinafter referred to as pintles and designated by reference numeral 230, are actuated by means of a pivotably mounted joystick 232 rather than by control puck 204. Joystick 232, having an optional flexible seal 250, is movably mounted for engagement with pintles 230 disposed radially therearound. Joystick 232 is actuated by yoke plates 234, 236 of an actuator assembly similar to that described above. The pivoting motion of the joystick 232 can be selectively coupled to the pintles 230 by controlling its pivoting action at pivot bearing 233. In this manner, selective control of the flow of exhaust gases from pressure chamber 238 through nozzles 240, in response to movement of the yoke plates and in coordination with the aerofins 120, is attained.

Figure 10A:
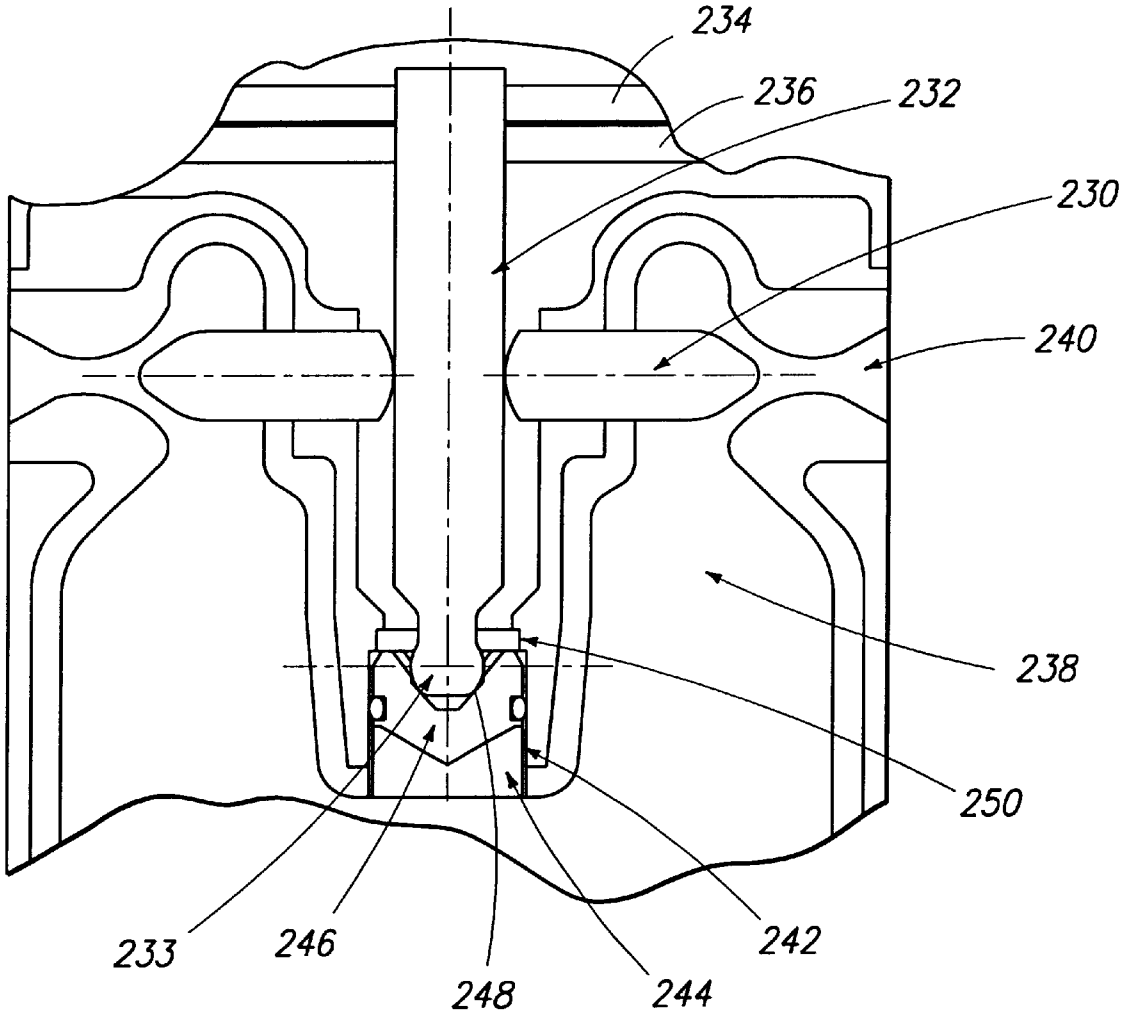
FIG. 10A is a schematic view of the variable coupling mechanism of the invention, in the engaged position, according to a first embodiment in which a single piston is used.

FIG. 10A shows the variable coupling mechanism of the invention in the engaged position. A pivot seat 246 having bearing surface 248 is mounted on a translating piston 244. Piston 244 is mounted in piston bearing 242 and translates axially therein. Piston bearing 242 is in communication with pressure chamber 238, permitting the axial position of the pivot seat 246 and the piston 244 to change according to pressure in pressure chamber 238. Under pressurization conditions, pivot seat 246 is forced into the engaged position of FIG. 10A to thereby contact pivot bearing 233 and provide a pivoting surface for the pivot bearing 233, limiting the motion of joystick 232 to a pivoting action. In this configuration, the motion of aerofins 120 via yoke plates 234, 236 is effectively coupled to thrust nozzles 240, with movement of the aerofins causing corresponding thrusting of the jet reaction control system to achieve integrated steering of the missile.

Figure 10B:
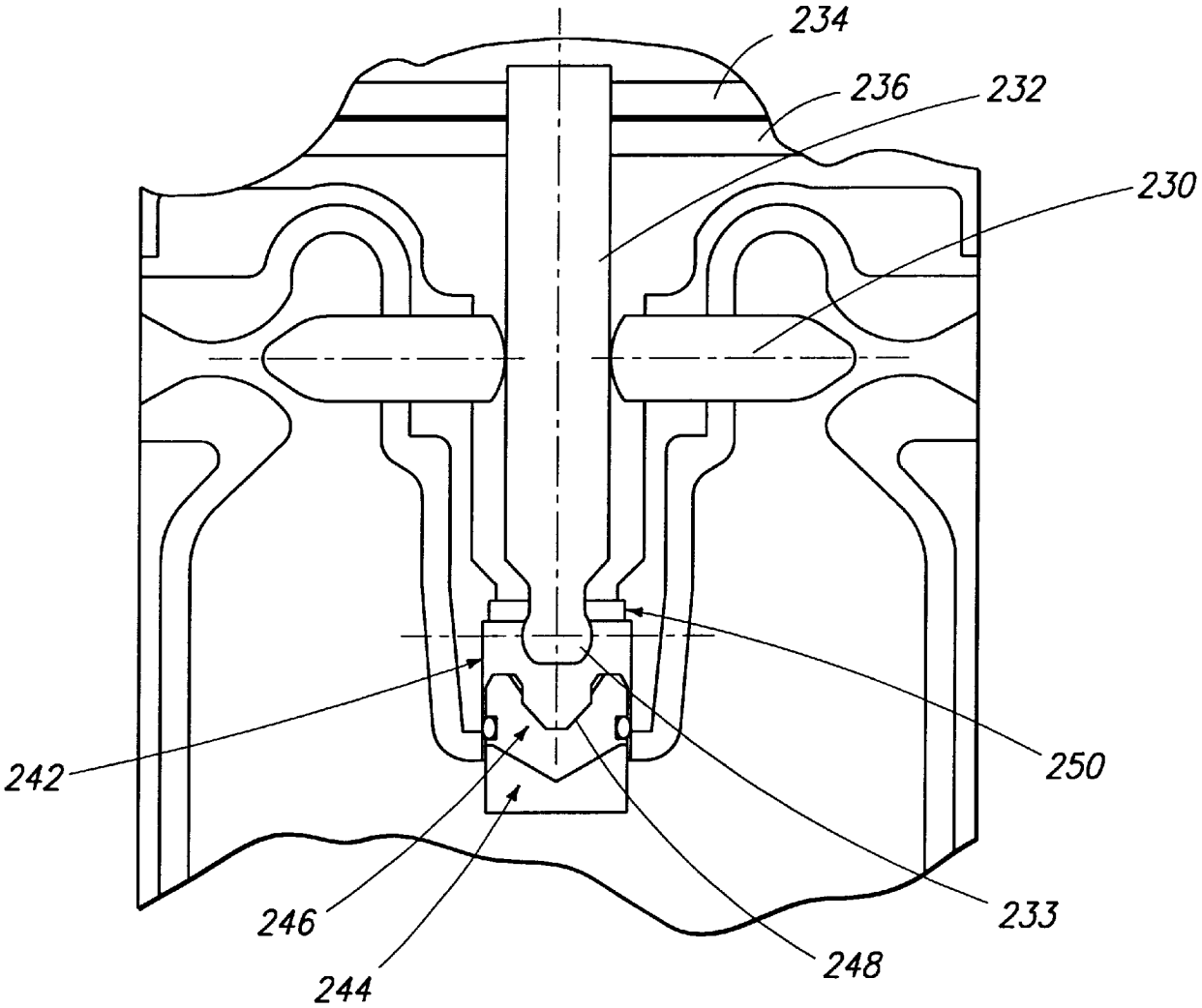
FIG. 10B is a schematic view of the embodiment of FIG. 10A in the disengaged position.

When pressure chamber 238 depressurizes, piston 244 and pivot seat 246 are caused to translate axially away from pivot bearing 233, by forces on the joystick 232, to the position illustrated in FIG. 10B. This disables the pivoting action of joystick 232, decoupling the motion of yoke plates 234 and 236 from pintles 230.

Figure 11A:
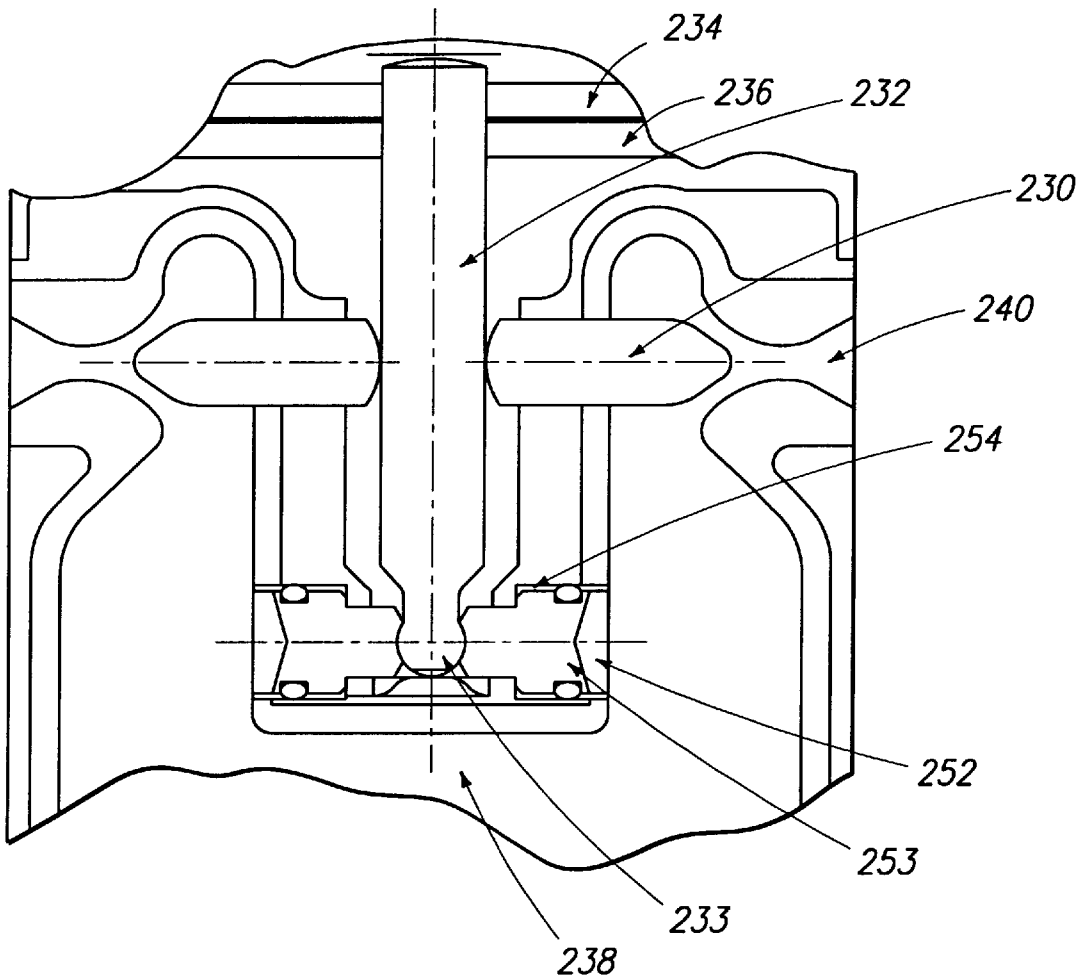
FIG. 11A is a schematic view of the variable coupling mechanism of the invention, in the engaged position, according to a second embodiment of the invention in which a piston array is used.
Figure 11B:
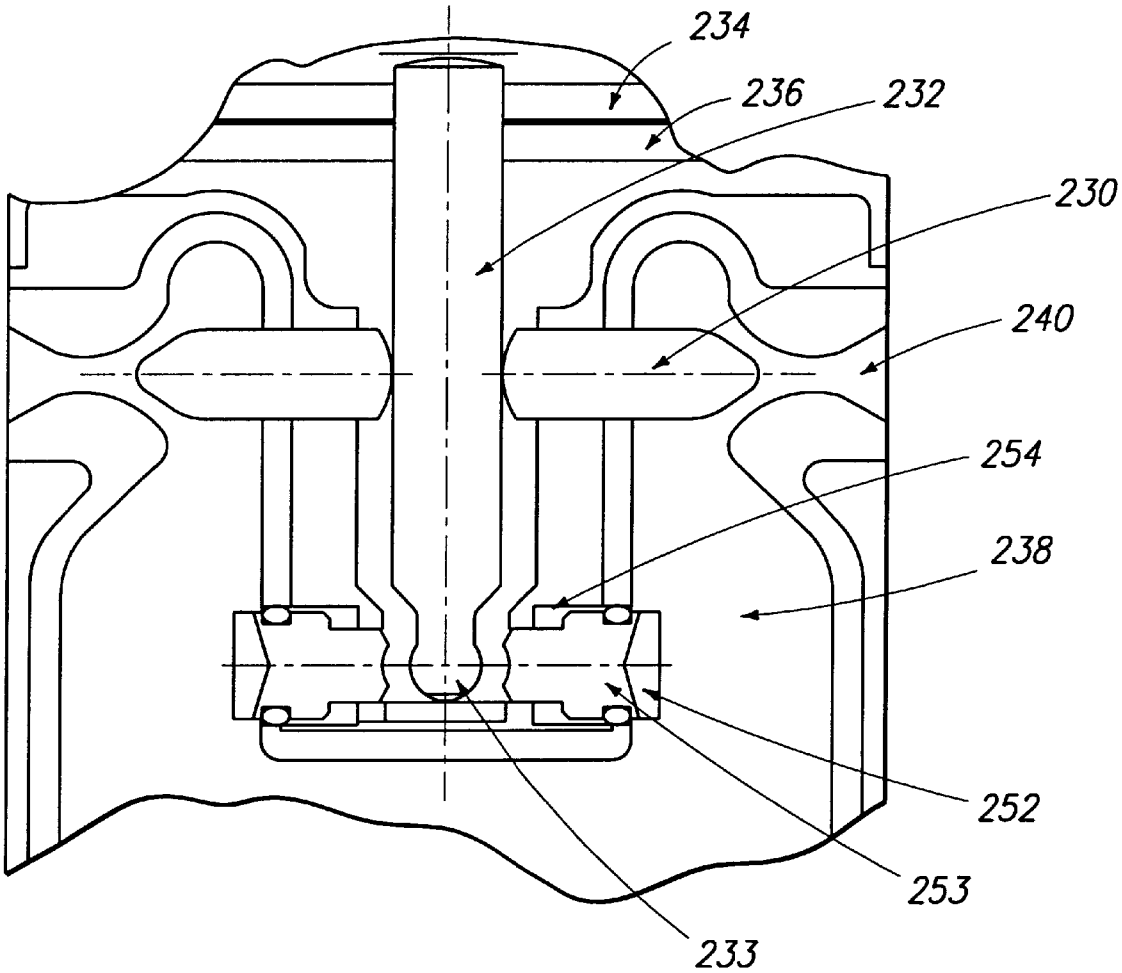
FIG. 11B is a schematic view of the embodiment of FIG. 11A in the disengaged position.

In a second embodiment of the invention depicted in FIGS. 11A and 11B, rather than a single piston 244, a pivot seat array 253 is used to provide the pivoting surface for pivot bearing 233 and limit the motion of joystick 232. The pivot seat array 253 is mounted on a piston array 252 and translates in array bearing 254, which is in communication with pressure chamber 238. Pivot seat array 253 and piston array 252 operate to couple and decouple the motion of yoke plates 234, 236 from pintles 230 in accordance with the pressurization state of the pressure chamber. FIG. 11A depicts the pivot seat array 253 in the engaged position, while FIG. 11B depicts the array in the disengaged position.

A third embodiment of the invention encases pintles 230 within translating pintle housings 256 to form differential area pistons. Pintle housings 256 are actuated by joystick 232 and translate along housing bearings 258 to control the exhaust stream through nozzles 240. Contained within each pintle housing 256 is expansible subchamber 260 which has as a boundary thereof one edge of pintle 230. Subchamber 260 communicates with pressure chamber 238 via channels 262 formed in pintles 230. When pressure chamber 238 is pressurized, pressure in subchamber 260 forces pintle 230 outward a corresponding distance, allowing a normal response of the pintles to yoke plates 234 and 236 and joystick 232. In this configuration, depicted in FIG. 12A, small motions of the yoke plates and joystick are sufficient to provide gas flow control through nozzles 240 and effect missile steering.

Figure 12A:
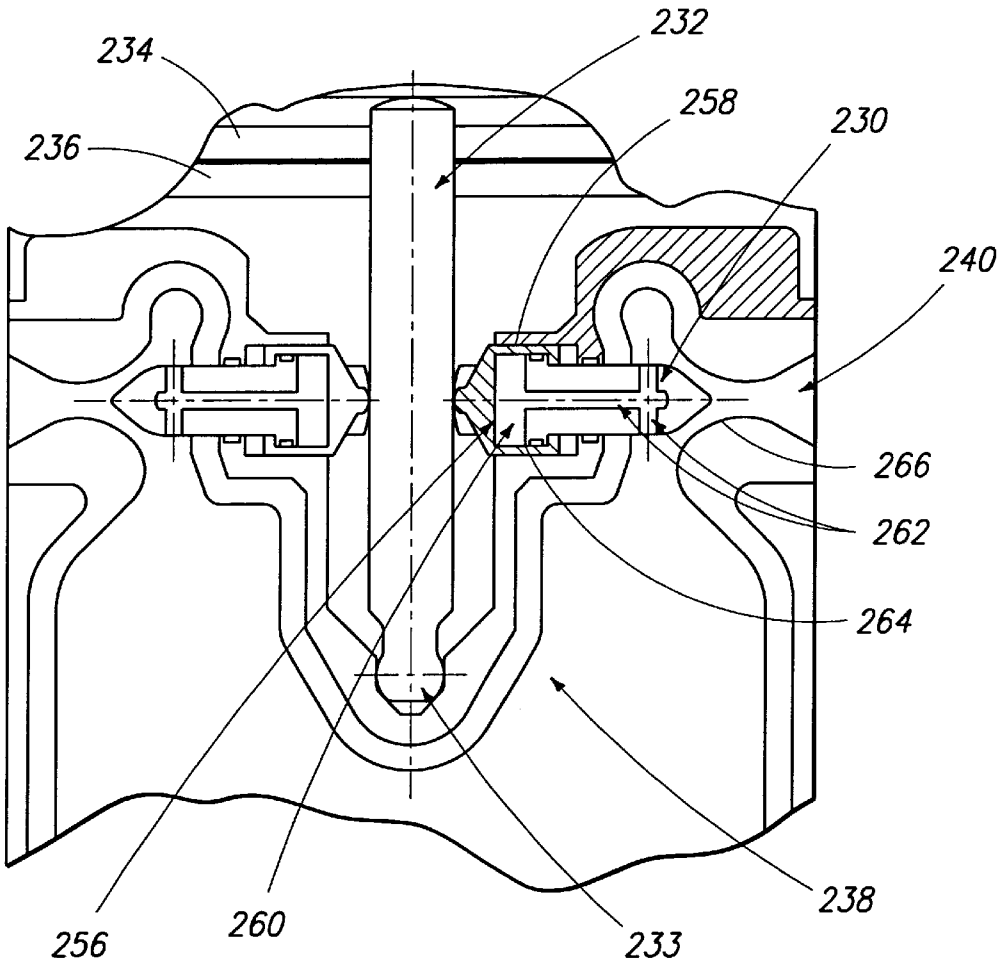
FIG. 12A is a schematic view of the variable coupling mechanism of the invention, with the pintles in an extended position, according to a third embodiment of the invention in which a differential area piston is used.
Figure 12B:
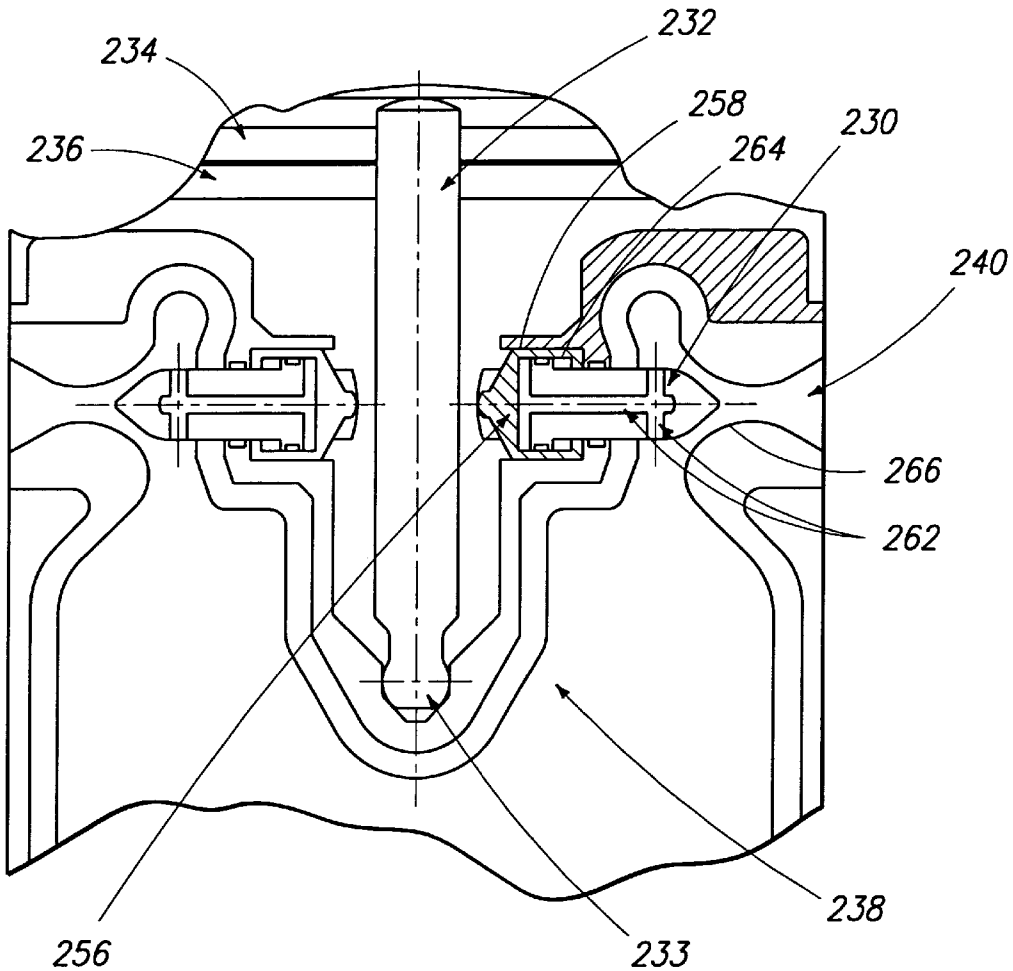
FIG. 12B is a schematic view of the embodiment of FIG. 12A with the pintles in a retracted position.

Upon depressurization or burn out, the differential area piston allows the pintle 230 to retract into pintle housing 256 when the joystick 232 presses pintle 230 against nozzle throat 266. In this manner, the arrangement decouples the jet reaction control (JRC) system from the aerofin control during periods of depressurization. The decoupling permits greater range of motion of the aerofins as they are no longer inhibited by the limited range of motion of the pintles 230 to which the aerofins were coupled. Moreover, the system permits recoupling when the pressure chamber 238 repressurizes in situations where the need for extreme aerofin motions is reduced and jet reaction control is desired. The decoupled configuration is illustrated in FIG. 12B.

Figure 13A:
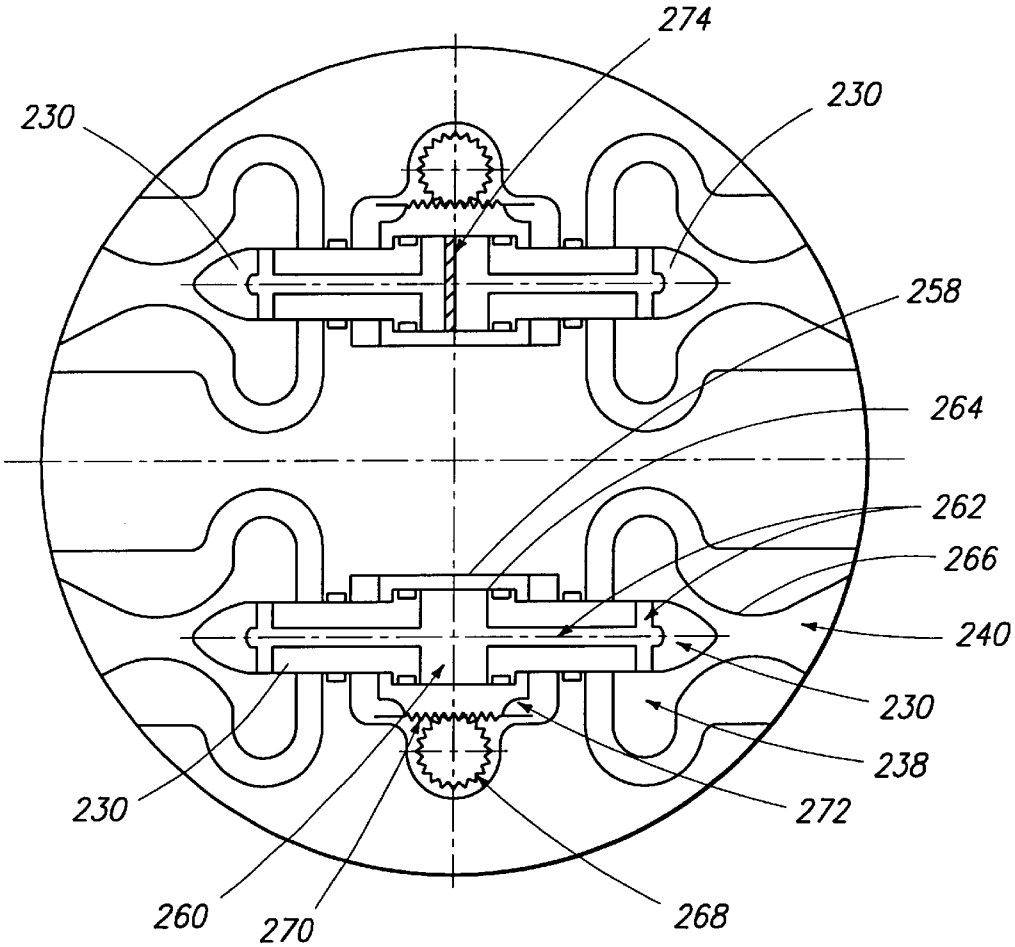
FIG. 13A is a schematic view of the variable coupling mechanism of the invention, with the pintles in an extended position, according to a fourth embodiment of the invention.
Figure 13B:
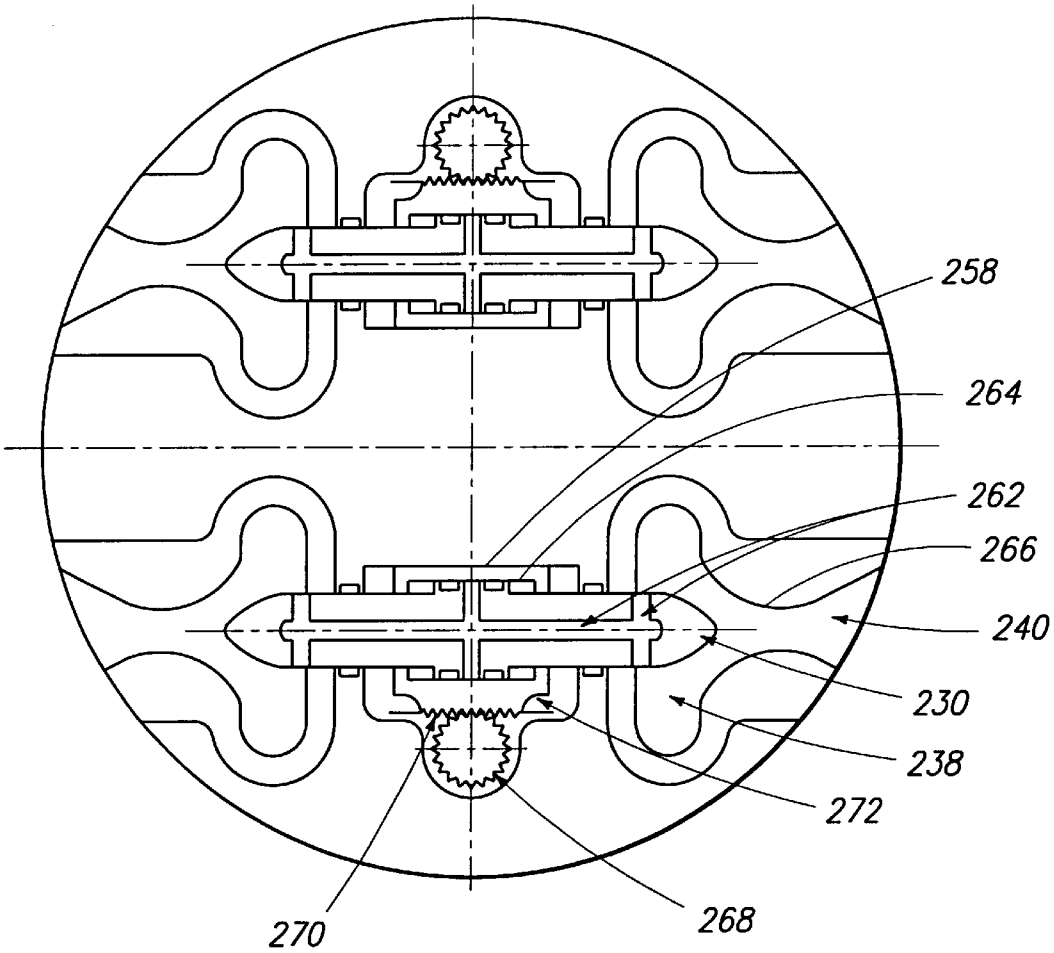
FIG. 13B is a schematic view of the embodiment of FIG. 13A with the pintles in a retracted position.

In an alternative embodiment shown in FIGS. 13A and 13B, pinion gears 268 replace joystick 232. Two pinion gears 268, each associated with a pair of pintles 230 mounted in a housing 272, couple the aerofin control system to the jet reaction control system. The housings 272 are each provided with a rack gear 270 for engagement with the pinion gears 268. A subchamber 260 is formed in each housing and optionally contains a bulkhead 274 therein. The subchamber is bounded at two opposing ends by pintles 230, which pintles have channels 262 formed therein to permit communication of the subchambers 260 with the pressure chamber 238. Pressure in pressure chamber 238 causes outward extension of pintles 230 along pintle bearings 264 formed in the housings 272, allowing normal control of the gas flow through nozzles 240 by the pintles in response to actuation of housings 272 by pinion gears 268.

Under depressurization conditions, depicted in FIG. 13B, pintles 230 are permitted to retract into the housings 272 when pressed against the nozzle throats 266, reducing the response of the jet reaction control system to pinion gears 268. This configuration affords maximum movement and control of the aerofins by removing constraints imposed by the otherwise limited motion of the pintles 230. The arrangement thus achieves a simple, variable response system which adjusts to the exigencies of the particular missile flight conditions.

Although there have been described hereinabove various specific arrangements of a Variable Coupling Arrangement for an Integrated Missile Steering System in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. Variable response jet reaction control apparatus for controlling the flight of a missile, said apparatus comprising:

a pressure chamber;

a plurality of thrust nozzles in communication with said pressure chamber, said thrust nozzles adapted for directional emission of gases generated in said pressure chamber;

a movably mounted gas flow controller;

a plurality of pintles each associated with a corresponding one of said plurality of thrust nozzles, said pintles adapted to vary the flow of gases through said thrust nozzles in response to movement of said gas flow controller; and variable response means for adjusting the degree of responsiveness of said pintles to said gas flow controller;

wherein said variable response means comprises a pivot seat mounted for translation between an engaged position and a disengaged position in response to pressure in said pressure chamber, said pivot seat enabling said gas flow controller to swivel about a central axis when in said engaged position.

2. The apparatus of claim 1, wherein said pivot seat has a bearing surface for engagement with said gas flow controller, said pivot seat being mounted on a piston adapted to translate axially within a piston bearing, said piston bearing communicating with said pressure chamber and having a longitudinal axis coincident with said central axis.

3. The apparatus of claim 1, wherein said variable response means comprises a plurality of pivot seats having bearing surfaces for engagement with said gas flow controller, said pivot seats each mounted on an associated piston which is adapted to translate along an axis transverse to said central axis in response to pressure in said pressure chamber.

4. The apparatus of claim 1, wherein said gas flow controller is comprised of a joystick having at one end a flexible seal surrounding a girth thereof, and wherein said plurality of pintles is comprised of four pintles radially disposed around said joystick.

5. Variable response jet reaction control apparatus for controlling the flight of a missile, said apparatus comprising:

a pressure chamber;

a plurality of thrust nozzles in communication with said pressure chamber, said thrust nozzles adapted for directional emission of gases-generated in said pressure chamber;

a movably mounted gas flow controller;

a plurality of pintles each associated with a corresponding one of said plurality of thrust nozzles, said pintles adapted to vary the flow of gases through said thrust nozzles in response to movement of said gas flow controller; and variable response means for adjusting the degree it responsiveness of said pintles to said gas flow controller;

wherein said variable response means comprises a plurality of pintle housings mounted for translation in response to movement of said gas flow controller, said pintle housings each having a subchamber therein bounded at one end by an associated pintle, said associated pintle movably mounted in said pintle housing and protruding therefrom by a prescribed distance, said subchamber communicating with said pressure chamber through a channel formed in said associated pintle and adapted to change volume in response to pressure in said pressure chamber, said volume change causing a change in said prescribed distance.

6. Variable response jet reaction control apparatus for controlling the flight of a missile, said apparatus comprising:

a pressure chamber;

a plurality of thrust nozzles in communication with said pressure chamber, said thrust nozzles adapted for directional emission of gases generated in said pressure chamber;

a movably mounted gas flow controller;

a plurality of pintles each associated with a corresponding one of said plurality of thrust nozzles, said pintles adapted to vary the flow of gases through said thrust nozzles in response to movement of said gas flow controller; and variable response means for adjusting the degree of responsiveness of said pintles to said gas flow controller;

wherein said variable response means comprises a plurality of pintle housings each mounted for translation in response to movement of said gas flow controller, said pintle housings each having a subchamber therein bounded at one end by a first pintle and bounded at an opposing end by a second pintle, said first pintle protruding from said pintle housing by a first prescribed distance, said second pintle protruding from said pintle housing by a second prescribed distance, said subchamber communicating with said pressure chamber through channels formed in said first and second pintle and adapted to change volume in response to pressure in said pressure chamber, said volume change causing a change in said first and second prescribed distances.

7. The apparatus of claim 6, wherein said movement of each said pintle housing in response to said gas flow controller is effected through a rack gear of a rack and pinion gear assembly, said rack gear mounted to said pintle housing.

8. The apparatus of claim 6, wherein said plurality of pintle housings comprises a first pintle housing adapted to translate along a first axis in response to movement of said gas flow controller and a second pintle housing adapted to translate along a second axis in response to movement of said gas flow controller, said first axis being parallel to said second axis.

9. The apparatus of claim 6, wherein said subchamber is provided with a bulkhead disposed therein.

10. Apparatus for variably coupling a jet reaction control mechanism to an aerofin actuator in a missile comprising:

at least one pair of movable aerofins mounted on opposite sides of a missile for controlling missile flight;

a gas flow control mechanism for effecting missile control in accordance with the position of said aerofins;

an electric motor for each of said aerofins connected to be responsive to signals for controlling the missile in flight;

a gear train for each electric motor, each gear train having a first group of gears coupling a motor to an associated aerofin and a second group of gears coupled to drive said gas flow control mechanism;

a pressure chamber;

a plurality of thrust nozzles in communication with said pressure chamber, said thrust nozzles adapted for directional emission of gases generated in said pressure chamber;

a plurality of pintles each associated with one of said plurality of thrust nozzles, said pintles adapted to vary the flow of gases through said thrust nozzles in response to said gas flow control mechanism; and variable response means for adjusting the degree of responsiveness of said pintles to said gas flow control mechanism;

wherein said gas flow control mechanism comprises:

at least one movable yoke plate mounted transversely in said missile, said yoke plate adapted to be actuated by the second group of gears of a gear train in response to activation of the corresponding electric motor; and a pivotably mounted joystick surrounded at a segment thereof by said yoke plate, said joystick adapted to swivel about a central axis in response to movement of said yoke plate.

11. The apparatus of claim 10, wherein said variable response means comprises a pivot seat mounted for translation between an engaged position and a disengaged position in response to pressure in said pressure chamber, said pivot seat enabling said joystick to swivel about said central axis when in said engaged position.

12. The apparatus of claim 11 wherein said pivot seat has a bearing surface for engagement with said joystick, said pivot seat being mounted on a piston adapted to translate axially within a piston bearing, said piston bearing communicating with said pressure chamber and having a longitudinal axis coincident with said central axis.

13. The apparatus of claim 10, wherein said variable response means comprises a plurality of pivot seats having bearing surfaces for engagement with said joystick, said pivot seats each mounted on an associated piston which is adapted to translate along an axis transverse to said central axis in response to pressure in said pressure chamber.

14. The apparatus of claim 10, wherein said variable response means comprises a plurality of pintle housings mounted for translation in response to said joystick, said pintle housings each having a subchamber therein bounded at one end by an associated pintle, said associated pintle movably mounted in said pintle housing and protruding therefrom by a prescribed distance, said subchamber communicating with said pressure chamber through a channel formed in said associated pintle and adapted to change volume in response to pressure in said pressure chamber, said change in volume causing a change in said prescribed distance.

15. The apparatus of claim 10, wherein said gas flow control mechanism comprises a plurality of drive pinions each adapted to rotate in response to activation of a corresponding electric motor.

16. The apparatus of claim 15, wherein said variable response means comprises a plurality of pintle housings each having a rack gear coupled to a drive pinion of said gas flow control mechanism and mounted for translation in response to rotation of said drive pinion, said pintle housings each having therein a subchamber bounded at one end by a first pintle and at an opposing end by a second pintle, said first pintle protruding from said pintle housing by a first prescribed distance, said second pintle protruding from said pintle housing by a second prescribed distance, said subchamber communicating with said pressure chamber through channels formed in said first and second pintles and adapted to change volume in response to pressure in said pressure chamber, said change in volume causing a change in said first and second prescribed distances.

17. The apparatus of claim 10, wherein said plurality of pintles is comprised of four pintles radially disposed around said joystick.

18. The apparatus of claim 16, wherein said plurality of pintle housings comprises a first pintle housing adapted to translate along a first axis in response to said gas flow controller and a second pintle housing adapted to translate along a second axis in response to said gas flow controller, said first axis being parallel to said second axis.

19. The apparatus of claim 16, wherein said subchamber is provided with a bulkhead disposed therein.

20. The apparatus of claim 10, wherein said joystick has at one end a flexible seal surrounding a girth thereof, and wherein said plurality of pintles is comprised of four pintles radially disposed around said joystick.

21. The apparatus of claim 10, wherein two yoke plates are provided, the first of said two yoke plates being adapted to translate along a first axis, the second of said two yoke plates being adapted to translate along a second axis orthogonal to said first axis.

* * * * *